United States Patent [19]

Rued et al.

[11] 4,363,380

[45] Dec. 14, 1982

[54] ELEVATOR AND METHOD OF LIFTING

[76] Inventors: Glen A. Rued, 5005 NE. First Ter., Pompano Beach, Fla. 33064; Elmer J. Simpson, 1455 NW. 70th La., Margate, Fla. 33063

[21] Appl. No.: 141,377

[22] Filed: Apr. 18, 1980

[51] Int. Cl.[3] ..... B66B 11/04

[52] U.S. Cl. ..... 187/17; 92/146

[58] Field of Search ..... 187/17; 92/148, 146, 92/164, 68, 137, 117 R, 117 A; 254/89 H

[56] References Cited

U.S. PATENT DOCUMENTS

| | | | |
|---|---|---|---|
| 3,477,229 | 11/1969 | Katko | 92/117 R |
| 3,534,664 | 10/1970 | Ulinski | 92/146 |
| 3,609,974 | 10/1971 | Lado | 92/146 |
| 3,968,860 | 7/1976 | Attey | 187/17 |

*Primary Examiner*—Joseph J. Rolla
*Assistant Examiner*—Kenneth Noland
*Attorney, Agent, or Firm*—Eugene F. Malin

[57] ABSTRACT

An elevator lift system in which at least two connected hydraulic piston cylinder devices for controlling the vertical displacement of the lift platform above a lower level. One hydraulic cylinder includes a case connected to a second case and a piston slidably mounted within each case and movable in opposite directions. One of the hydraulic cylinders has a lift platform attached to its top end and the other hydraulic cylinder has its bottom end fixed to a base plate at a lower level. The hydraulic cylinders are connected to each other by the use of a housing which also encloses a control system which allows the rate of ascent or descent of both hydraulic cylinders to be equal. Multiple pairs of hydraulic cylinders are connectable to each other by way of a frame to reach additional heights and still allow the system to be lowered that the tops of all the cylinders are substantially flush. The frame includes another control system which allows the rate of ascent or descent of hydraulic cylinders of the pairs to be equal.

9 Claims, 7 Drawing Figures

ELEVATOR AND METHOD OF LIFTING

BACKGROUND OF THE INVENTION

This invention relates to elevator lifting systems and more particular to a hydraulic piston elevator lifting system of at least two connected hydraulic piston cylinder devices.

In the past, there have been various hydraulic elevator lifting systems. By way of example, is U.S. Pat. No. 3,613,834 in which an elevator lift is illustrated. A pair of readily displaced hydraulic lifting cylinders are used to lift the elevator car. In another example, U.S. Pat. No. 3,968,860, a hydraulic elevator installation is illustrated. A pair of cylinders are utilized with a common plunger to control the vertical movement of the elevator.

Another example is shown by U.S. Pat. No. 3,534,664, in which a lift truck mast and ram assembly is disclosed. A series of laterally displaced rams supported by a base plate and connected in series to a hydraulic circuit, control the raising and lowering of the lift.

The present invention overcomes the problems of the past by utilizing a plurality of hydraulic piston cylinder devices interconnected in a unique manner with a control system to achieve lifting heights not previously attainable in prior elevator lift systems heretofore.

SUMMARY OF THE INVENTION

This invention is directed to an elevator lift system utilizing at least two hydraulic piston cylinder devices or at least a pair of hydraulic piston cylinder devices to control the vertical displacement of an elevator car or platform. Each hydraulic cylinder includes a case, a cylinder head, and a hollow piston movable relative to the case. The piston is slidably mounted to the cylinder head. Having a portion disposed within the case and the other portion protruding from the end of the case to which the cylinder head is attached.

The hollow piston has a piston stop ring, which is larger in diameter than the piston, fixed to the end of the piston which remains disposed within the case. The piston stop ring has a hole drilled through it to allow fluid flow from the inside of the piston through the piston stop ring. A multiplicity of roller bearings are fixed to the outside edge of the piston stop ring and ride along the inner surface of the case to inhibit lateral displacement of the piston within the case.

The hydraulic piston cylinder devices are adjacently connected by one or more sprocket housings, which also contain a lower sprocket and an upper sprocket, both rotatably mounted in a vertical plane. The upper sprocket is mounted to a chain tensioner and the lower sprocket is mounted to the wall of the housing. The walls of each sprocket housing define a fluid passageway between the adjacently connected hydraulic cylinders, each cylinder having an aperture in its case where the sprocket housing is attached.

The control means or system includes a continuous chain that is connected around each sprocket and through each aperture in the cases of each hydraulic cylinder. The edge of each piston stop ring closest to the continuous chain is geared, and intermeshes with the continuous chain. Once the cylinders are filled with hydraulic fluid from a hydraulic fluid control conduit which is connected to one of the pistons, additional hydraulic fluid pressure will cause the elevator lift system to raise in a vertical direction. The elevator lift system is lowered by releasing the hydraulic fluid pressure.

Furthermore, when an additional hydraulic cylinder or pair of hydraulic cylinders is added to the system, a frame must be utilized with another control system or means such as the chain housing support cylinder. When the chain housing support cylinder and frame are added to the system, the exposed end of the second piston is connected to an upper frame member and the exposed end of the third piston is converted to a lower frame member.

It should be noted this connecting and control arrangement may be used when only a pair of hydraulic piston cylinder devices are inter-connected.

The chain housing support cylinder contains a continuous drive chain whose links intermesh with the geared edges of the second cylinder head and the third cylinder head. The drive chain presses over an upper sprocket and a lower adjustable sprocket both rotatably mounted to the chain housing support cylinder. This design allows the third cylinder casing to ascend or descend at the same rate as the second piston and also allows the third cylinder to be lowered to the same level as the second cylinder.

If a fourth cylinder were added, it would be connected to the third cylinder in the same manner as the first cylinder is connected to the second cylinder; or each pair of hydraulic cylinders would be connected to each other in the same manner as the first cylinder is connected to the second cylinder, but a pair of hydraulic cylinders would be connected to an adjacent pair of cylinders as just described.

Three pairs of hydraulic piston cylinder devices can be connected together in a delta-shaped manner as viewed in a plan view, thus reducing the width of the pit area or elevator shaft area and reducing the number of guide rails needed for the elevator system.

It is therefore the primary object of this invention to provide a controlled elevator system in which the rate of displacement of each adjacently movable member in a pair of connected hydraulic piston cylinder devices is equal.

It is another object of this invention to provide a controlled elevator system which can be added to in building block fashion so as to be utilized to service a greater number of floors than prior elevator piston systems.

It is a further object of this system to provide a non-complex controlled elevator system using at least a pair of hydraulic piston cylinder devices to provide lower cost lift service.

In accordance with these and other objects which will be apparent hereinafter, the instant invention will now be described with particular reference to the accompanying drawings.

DESCRIPTION OF THE PREFERRED EMBODIMENT

Figure 1:
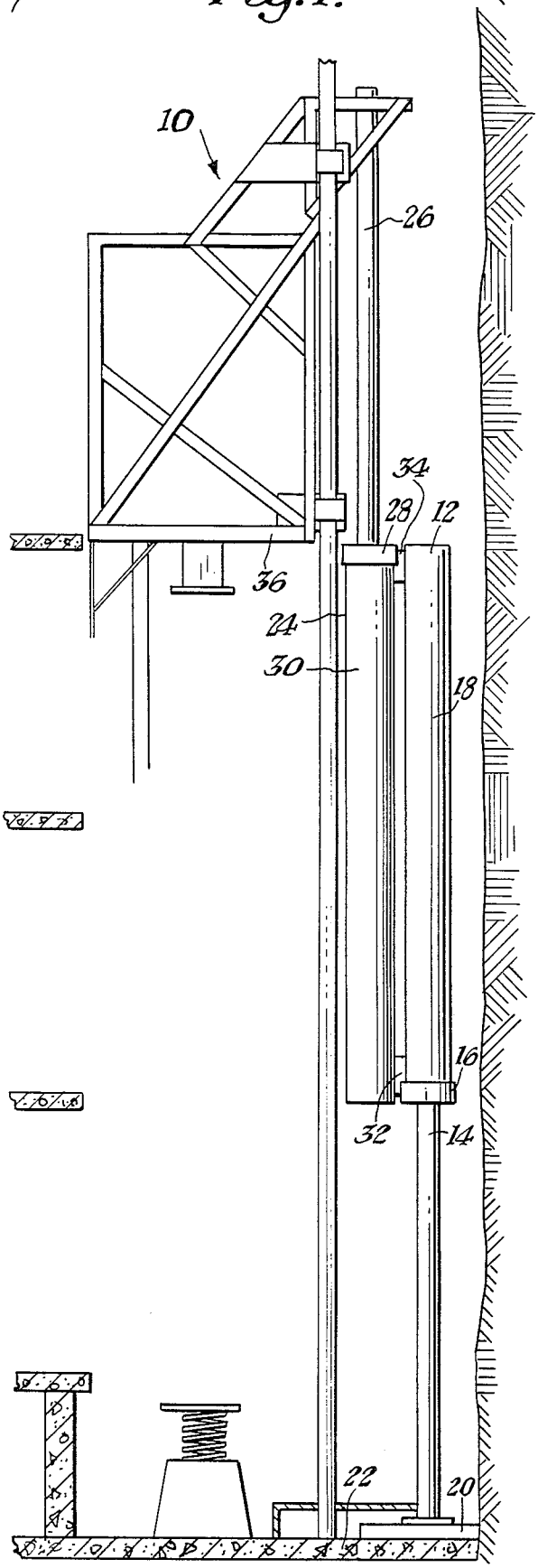
FIG. 1 is a side elevational view of a two piston elevator system in the fully extended position.

Referring to FIG. 1, the elevator system 10 is shown. A first hydraulic piston cylinder device or first hydraulic cylinder 12 has a first piston 14 slidably mounted to a first cylinder head 16 which is fixed to a first cylinder case 18. The exposed end of the first piston 14 is welded to an anchor plate 20, the anchor plate 20 being bolted to the floor 22. A second hydraulic cylinder 24 which also has a second piston 26 slidably mounted to a second cylinder head 28 which is fixed to a second cylinder case 30 is utilized.

The second hydraulic piston cylinder device or second hydraulic cylinder 24 is connected to the first hydraulic cylinder 12 by a lower sprocket housing 32 and an upper sprocket housing 34 such that the exposed end of the second piston 26 extends upwardly from the second cylinder case 30. An elevator car 36 is attached to the exposed end of the second piston 26.

Figure 2:
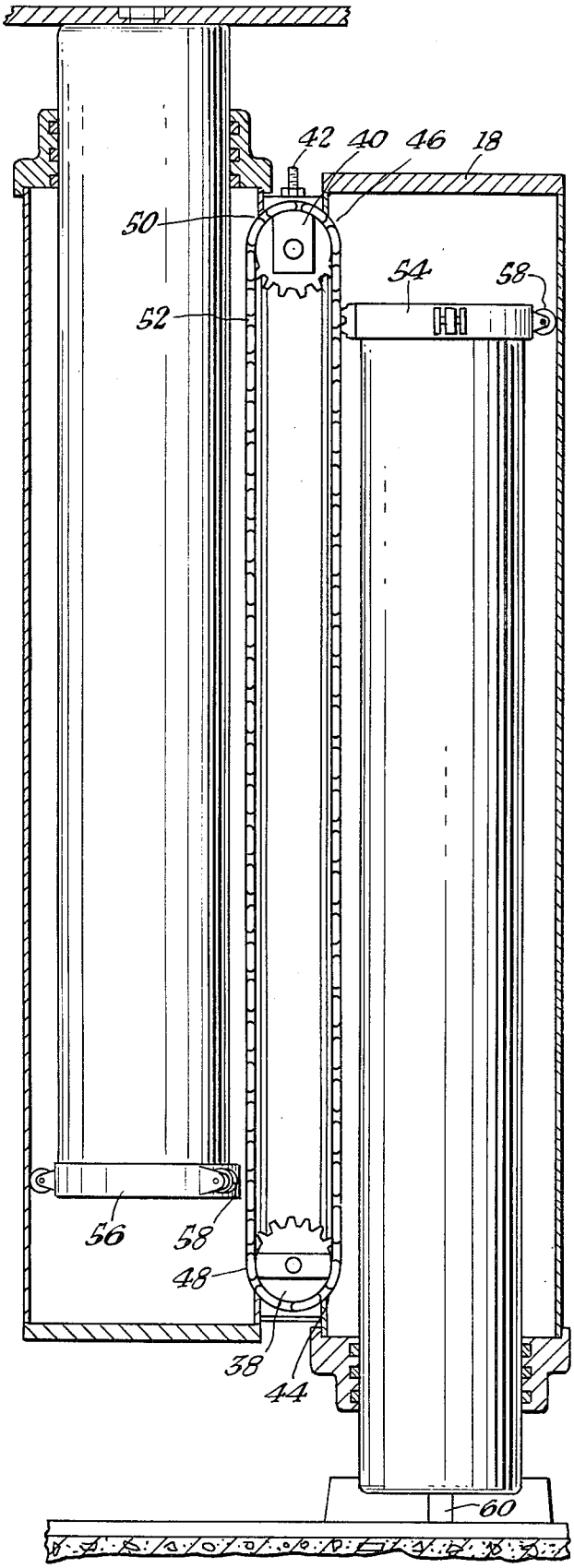
FIG. 2 is a cross-sectional view of the two pistons of the elevator system taken along the line 2 in the direction of the arrows.

Referring now to FIG. 2, each sprocket housing 32 and 34 contains a respective sprocket 38 and 40. The lowermost sprocket 38 is rotatably mounted in a vertical plane to the wall of the respective housing 32 in which it is contained. The uppermost sprocket 40 is rotatably mounted in a vertical plane within the sprocket housing 34, to a chain tensioner 42 which is partially exposed on the outside of the housing 34 for adjustment.

The first cylinder case 18 has a first aperture 44 in its wall which defines a flow path into the sprocket housing 32 and a second aperture 46 which defines a flow path into the sprocket housing 34.

The second cylinder case 30 has a third aperture 48 in its wall which defines a flow path into the sprocket housing 32 and a fourth aperture 50 which defines a flow path into the sprocket housing 34.

A continuous chain 52 passes through each aperture 44, 46, 48 and 50 and around each sprocket 38 and 40 so that the links of the continuous chain 52 intermesh with a predetermined number of teeth of each sprocket 38 and 40. Proper chain tension can be obtained by adjusting the chain tensioner 42.

The first piston 14 and the second piston 26 each have a respective stop ring 54 and 56 attached to the end of the respective piston 14 or 26 contained within the respective cylinder case 18 or 30. The edge of each stop ring 54 and 56, which is adjacent the continuous chain 52 is geared to intermesh with the links of the chain 52. Each stop ring 54 and 56 has a multiplicity of roller bearings 58 fixed around its outer periphery. The roller bearings 58 travel along the inner surface of the first and second pistons 14 and 26 from lateral movement within the respective cylinder cases 18 and 30.

The exposed end of the first piston 14 has a hydraulic fluid conduit 60 connected thereto. In order to raise the elevator car 36, hydraulic fluid is forced through the hydraulic fluid conduit 60 into the inside of the first piston 14, upwardly through the first piston 14 and into the first cylinder case 18. The hydraulic fluid from the first hydraulic cylinder 12 also flows through the first aperture 44, second aperture 46, third aperture 48, and fourth aperture 50 into the second hydraulic cylinder 24.

Once the first hydraulic cylinder 12 and the second hydraulic cylinder 24 are filled with hydraulic fluid, any additional hydraulic fluid introduced into the system will force the first cylinder case 18 and the second piston 26 upwardly until the piston stop rings 54 and 56 contact a respective cylinder head 16 and 28, inhibiting further displacement of the pistons 14 and 26. Since the geared edges of each stop ring 54 and 56 are intermeshed with the continuous chain 52, the rate of ascent or descent of the second piston 26 will be equal to the rate of ascent or descent of the first cylinder case 18. In order to lower the elevator to the position shown in FIG. 3, the hydraulic fluid pressure is released through the hydraulic fluid conduit 60.

Figure 4:
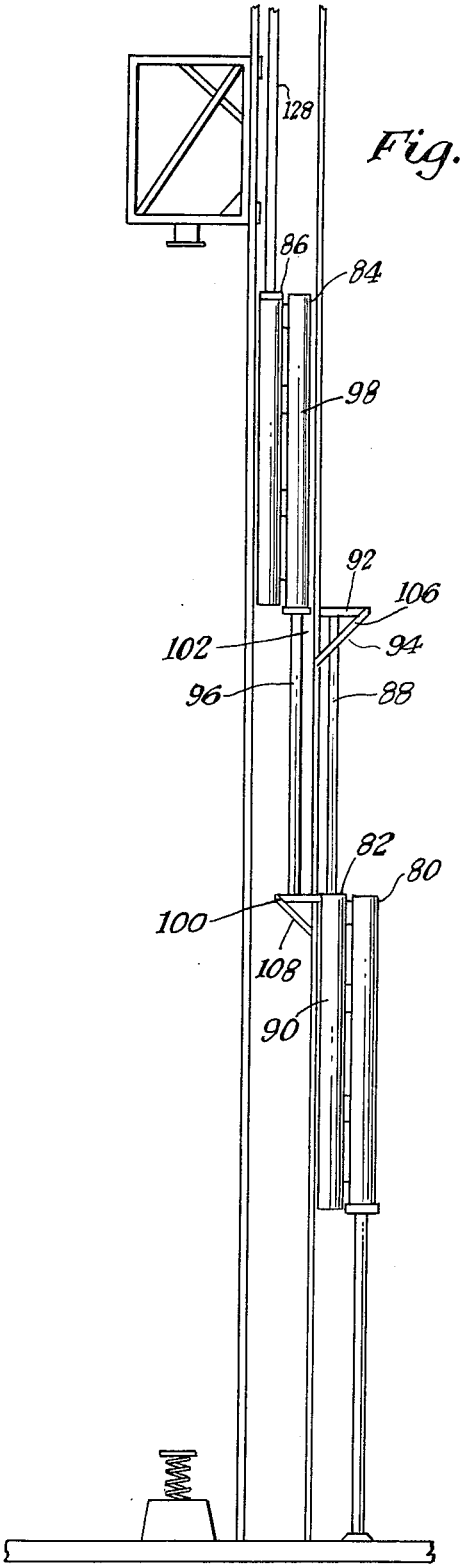
FIG. 4 is a side elevational view of a four piston elevator system in a fully extended position.
Figure 5:
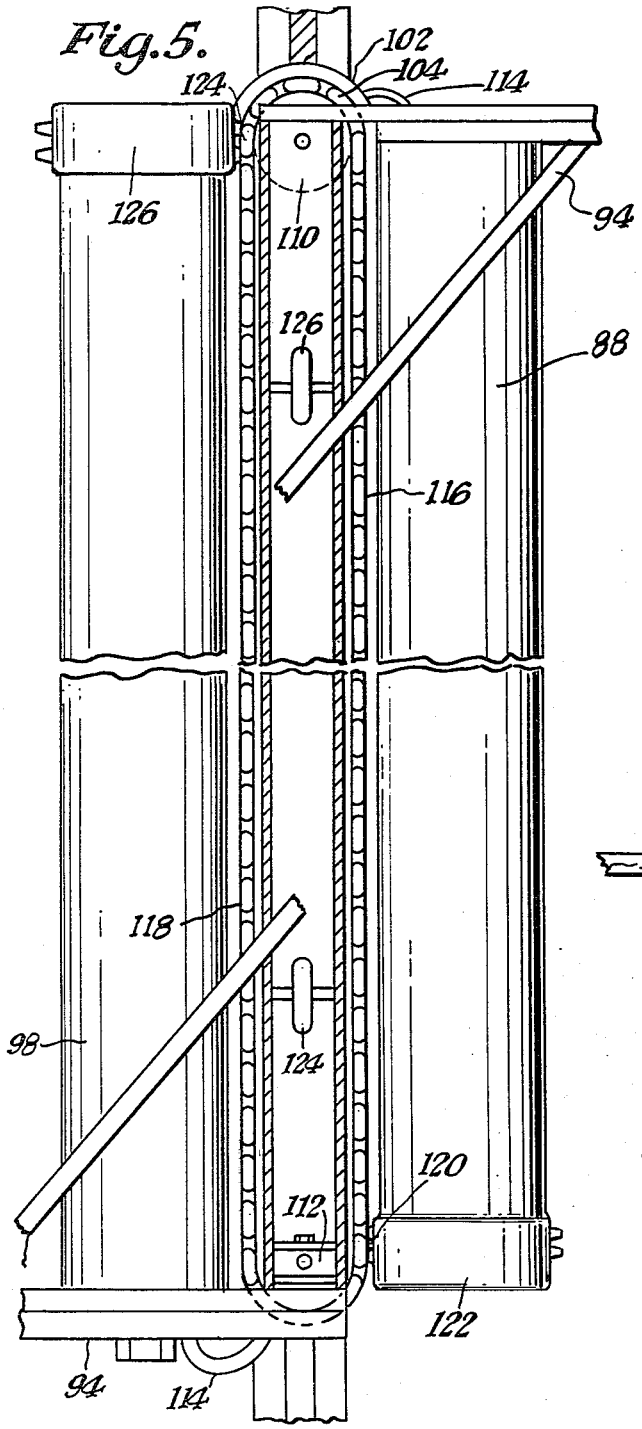
FIG. 5 is a side view of the second and third pistons of a four piston elevator system partially in cross-section.
Figure 6:
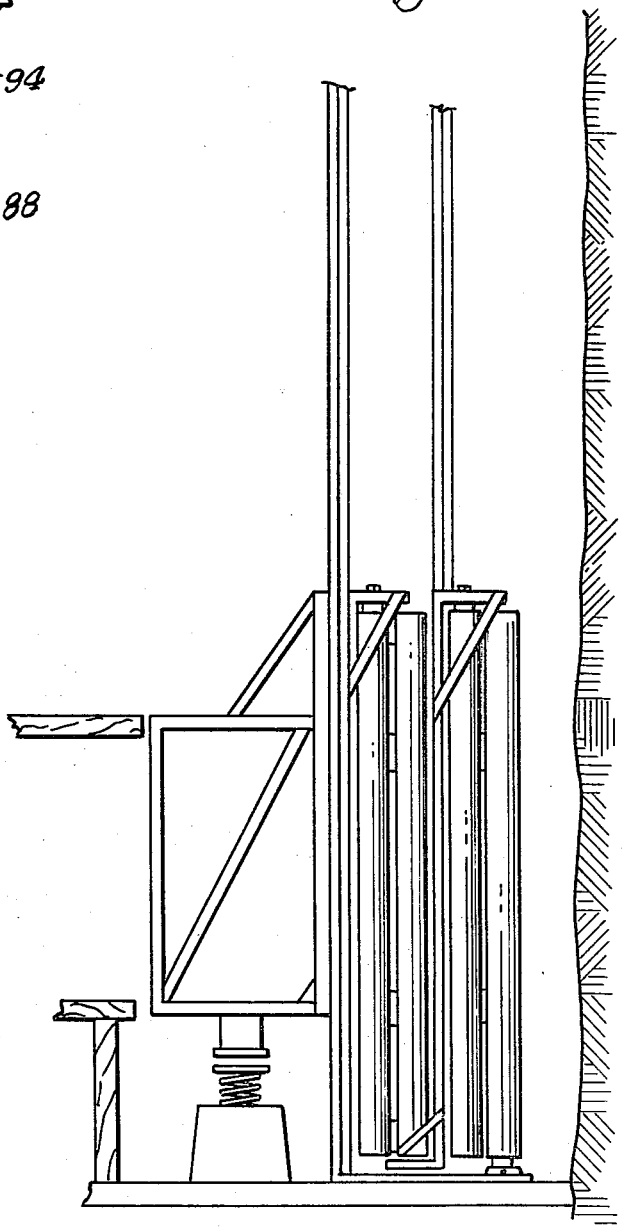
FIG. 6 is a side elevational view of a four piston elevator system in a lowered position.

Referring to FIGS. 4, 5, and 6, an elevator lift system utilizing four hydraulic cylinders 80, 82, 84, and 86 to raise an elevator car a distance equivalent to five cylinders is illustrated.

Figure 3:
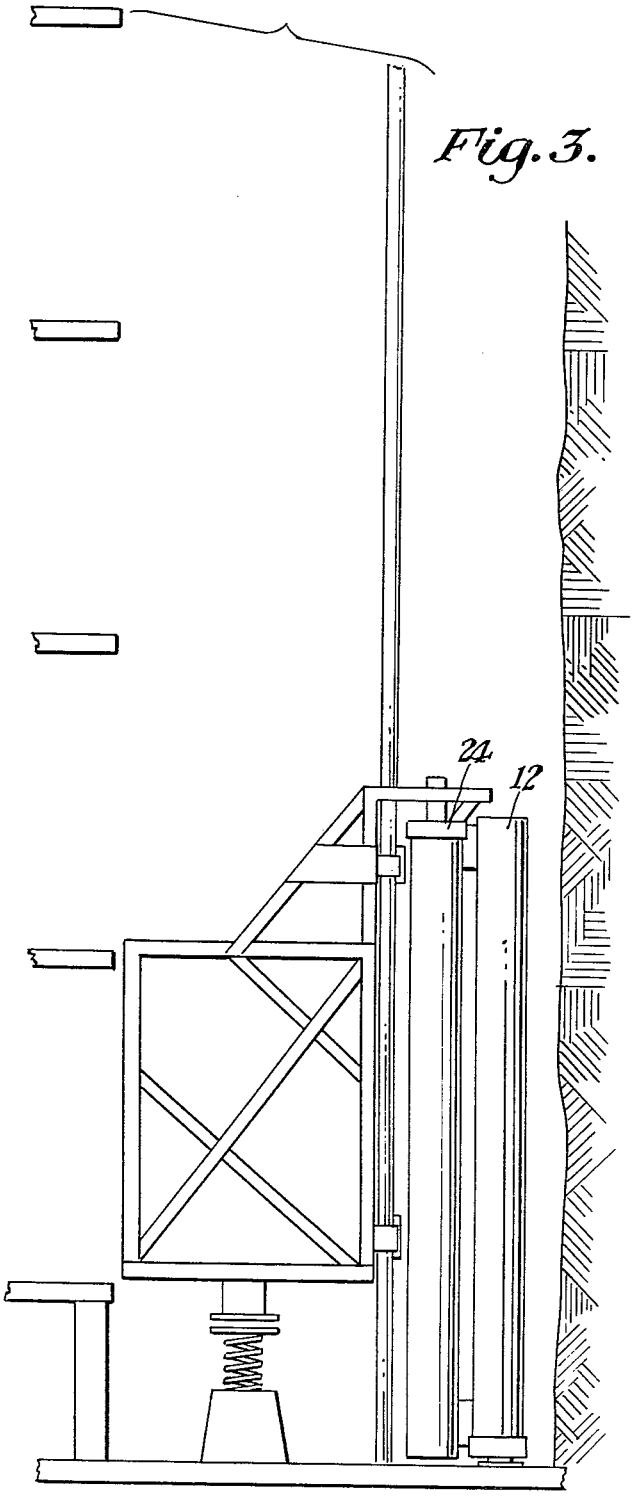
FIG. 3 is a side elevational view of a two piston elevator system in the lowered position.

The adjacent hydraulic cylinders 80 and 82, and 84 and 86 work cooperatively as described in the aforementioned description of FIG. 1, FIG. 2, and FIG. 3.

The second hydraulic cylinder 82 has the exposed end of its second piston 88, which extends upwardly from the second cylinder case 90, connected to the upper member 92 of the frame 94, while the third hydraulic cylinder 84 has the exposed end of its third piston 96, which extends downwardly from the third cylinder case 98, connected to the lower member 100 of the frame 94.

The upper member 92 is connected to the top of a chain housing support cylinder 102 which houses a drive chain 104. The upper member 92 is additionally supported by an upper brace member 106 which is also connected to the chain housing support cylinder 102. The lower member 100 is connected to the bottom of the chain housing support cylinder 102. The lower member 100 is additionally supported by a lower brace member 108 which is also connected to the chain housing support cylinder 102.

Within the chain housing support cylinder 102 is a continuous drive chain 104. The continuous drive chain passes around an upper sprocket 110 and an adjustable lower sprocket 112, such that the teeth of each sprocket 110 and 112 intermesh with the links of the drive chain 104. The drive chain 104 tension can be varied by adjusting the adjustable lower sprocket 112 upwardly or downwardly. The chain housing support cylinder 102 also contains a portion of a hydraulic fluid conduit 114. The hydraulic fluid conduit 114 has one end sealingly connected to the exposed end of the second piston 88 and the other end sealingly converted to the exposed end of the third piston 96, allowing fluid communication therebetween.

The chain housing support cylinder 102 also has a pair of longitudinal slots 116 and 118 disposed 180° from each other about the chain-housing support cylinder 102, exposing opposite sides of the continuous drive chain 104. The geared edge 120 of the second cylinder head 122 intermeshes with the links of one side of the drive chain 104, while the geared edge 124 of the third cylinder head 126 intermeshes with the links of the other side of the drive chain 104. The chain-housing support cylinder 102 further includes a top guide shoe brace 126 and a bottom guide shoe brace 124 which can be inserted within a T rail or other carrier guide to keep the elevator piston system in proper alignment within the elevator shaft. This design insures that the rate of ascent or descent of the second piston 88, the frame 94 and the third cylinder case 98 remains constant.

In actual operation, assuming that the elevator piston system starts in a completely lowered position as shown in FIG. 6, as hydraulic fluid is forced into the system, the first hydraulic cylinder case begins to ascend at the same rate as the second piston, due to the cooperation of the first and second pistons as previously described. As the second piston begins to ascend, both the frame 94 and the third cylinder case 98 also begin to ascend at a constant rate due to the interconnection of the second cylinder case 90 to the third cylinder case 98 via the drive chain 104. Since the third piston 96 cooperates with the fourth piston 128 in the same manner as previously described, the fourth piston also ascends at the same rate as the second piston. Because of the aforementioned structure, the rate of descent of the pistons and cylinders will also be constant.

The frame 94 allows the third cylinder 84 to be lowered to a position of substantially equal height as the first hydraulic cylinder 80 and second hydraulic cylinder 82. As the second piston 88 descends, the frame 94 also descends relative to the second hydraulic cylinder case 90, such that in the fully lowered position the third hydraulic cylinder case 98 has its bottom substantially at the same level as the bottom of the second hydraulic cylinder case. Thus, the third hydraulic cylinder case 98 travels twice the vertical distance as the second hydraulic cylinder case 90.

Figure 7:
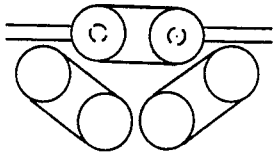
FIG. 7 is a top elevational view of a six piston elevator system with the elevator car removed.

Now referring to FIG. 7 an alternative embodiment is disclosed which utilizes three pairs of adjacently connected hydraulic cylinders. The same principles as previously described are employed to connect adjacent cylinders and adjacent pairs of cylinders to allow upward and downward movement of the elevator.

However, when using this many pistons if they were to be connected in a side by side array the width of the pit which would house the pistons would become impractical for use. Therefore as shown in FIG. 7, the pistons can be arranged in a delta shaped arrangement. The advantage of this arrangement is that only two guard rails are needed, one for each chain housing support cylinder as shown.

The instant invention has been shown and described herein in what is considered to be the most practical and preferred embodiment. It is recognized, however, that departures may be made therefrom within the scope of the invention and that obvious modifications will occur to a person skilled in the art.

What we claim is:

1. An elevator system for raising items from a lower level and lowering items to the lower level, comprising:

a lift member;

at least a first hydraulic piston cylinder device and a second hydraulic piston cylinder device, said first device including at least two parts, said at least two parts of said first device including a first part which consists of a first casing and a second part which consists of a first piston relatively movable in relation to one another, said second device including at least two parts, said at least two parts of said second device including a first part which consists of a second casing and a second part which consists of a second piston movable relative to one another;

said first part of said first device is fixedly connected to said first part of said second device allowing fluid communication therebetween;

said first device connected to said lift member;

said second device connected to the lower level;

control means for regulating the travel length of the second part of said first device and said second device respectively, said control means functions to displace the second device simultaneously with the first device when the second part of said second device moves relatively to said first part of said first device and said first part of said second device, said control means is connected to said second part of said first device and said second device respectively.

2. An elevator system for raising items from a lower leveland lowering items to the lower level, comprising:

a lift member;

at least a first hydraulic piston cylinder device and a second hydraulic piston cylinder device, said at least two parts of said first device including at least two parts, said first device including a first part which consists of a first casing and a second part which consists of a first piston relatively movable in relation to one another, said second device including at least two parts, said at least two parts of said second device including a first part which consists of a second casing and a second part which consists of a second piston movable relative to one another;

said first part of said first device is connected to said first part of said second device allowing fluid communication therebetween;

said first device connected to said lift member;

said second device connected to the lower level;

control means for regulating the travel length of the second part of said first device and said second device respectively, said control means functions to displace the second device simultaneously with the first device when the second part of said second device moves relatively to said first part of said first device and said first part of said second device;

said lift member is a lift platform;

said first hydraulic piston cylinder device and said second hydraulic piston cylinder device providing a first pair of devices;

a second pair of devices similar to said first pair, said second pair of devices including a third hydraulic piston cylinder device including at least two parts, said third hydraulic piston cylinder device including a third casing and a third piston said fourth hydraulic piston cylinder device including at least two parts, said fourth hydraulic piston cylinder device including a third casing and a third piston;

said first casing connected to said second casing allowing fluid communication therebetween;

said third casing connected to said fourth casing allowing fluid communication therebetween;

said control means regulating the travel length of said first piston and said second piston simultaneously at the same rate;

a second control means for regulating the travel length of said fourth piston and said third piston simultaneously at the same rate;

third control means for regulating the travel length between said third case and said fourth case simultaneously at the same rate allowing said third device and said fourth device to be lowered to the same height as said first device and second device;

said second piston and said third piston connected to allow fluid communication therebetween.

3. An elevator system as set forth in claim 2, including:

said second piston having a distal end connected to said third control means;

said third piston having said distal end connected to said third control means; said third control means is a fixed platform.

4. An elevator system as set forth in claim 2, including:

a fluid conduit means for allowing fluid communication between said first piston, said first case, said second case, said second piston, said third piston, said third case, said fourth case, and said fourth piston to provide a single height double pair of said devices movable to approximately five times the compacted height.

5. An elevator lift system as set forth in claim 4, including:

said second control means similar to said first control means;

said third control means includes a chain housing support cylinder having a fifth sprocket, a sixth sprocket, a third continuous drive chain and a frame;

said frame having an upper member and a lower member;

said fourth sprocket and said sixth sprocket rotatably mounted to said support cylinder with said continuous drive chain connected thereabout;

said second case and said third case connected to said second continuous drive chain;

said distal end of said second piston connected to said upper member; and said distal end of said third piston connected to said lower member, such that when said elevator lift system is fully extended, said third casing has travelled a greater distance than said second casing.

6. An elevator lift system, comprising:

at least a first pair of hydraulic cylinders and a second pair of hydraulic cylinders;

said first pair of hydraulic cylinders having a first pair of pistons;

a first control means for regulating the travel lengths of said first pair of pistons simultaneously at the same rate;

said first control means connected to said first pair of pistons;

said second pair of hydraulic cylinders having a second pair of pistons;

a second control means for regulating the travel length of said second pair of pistons simultaneously at the same rate;

said second control means connected to said second part of pistons;

a third control means for connecting said first pair of hydraulic cylinders to said second pair of hydraulic cylinders and for regulating the travel length of said first pair of pistons and said second pair of pistons simultaneously at the same rate, such that said second pair of hydraulic cylinders can be lowered to the same starting height as said first pair of hydraulic cylinders.

7. An elevator lift system, comprising:

at least a first pair of hydraulic cylinders and a second pair of hydraulic cylinders;

said first pair of hydraulic cylinders having a first pair of pistons;

a first control means for regulating the travel lengths of said first pair of pistons simultaneously at the same rate;

said second pair of hydraulic cylinders having a second pair of pistons;

a second control means for regulating the travel length of said second pair of pistons simultaneously at the same rate;

a third control means for connecting said first pair of hydraulic cylinders to said second pair of hydraulic cylinders and for regulating the travel length of said first pair of pistons and said second pair of pistons simultaneously at the same rate, such that said second pair of hydraulic cylinders can be lowered to the same starting height as said first pair of hydraulic cylinders;

a third pair of hydraulic cylinders;

said third pair of hydraulic cylinders having a third pair of pistons;

a fourth control means for connecting said third pair of hydraulic cylinders to said second pair of hydraulic cylinders and for regulating the travel length of said third pair of pistons and said second pair of pistons simultaneously at the same rate, such that said third of hydraulic cylinders can be lowered to the same starting height as said first pair of hydraulic cylinders and said second pair of hydraulic cylinders.

8. An elevator lift system as set forth in claim 7, wherein:

said first pair of hydraulic cylinders, said second pair of hydraulic cylinders and said third pair of hydraulic cylinders are connected in a delta-shaped array to minimize the area occupied by them.

9. An elevator system for raising items from a lower level and lowering items to the lower level, comprising:

a lift member;

at least a first hydraulic piston cylinder device and a second hydraulic piston cylinder device, said first device including at least two parts, said at least two parts of said first device including a first casing and a first piston relatively movable in relation to one another, said second device including at least two parts, said at least two parts of said second device including a second casing and a second piston movable relative to one another;

at least one part of said first device is connected to at least one part of said second device allowing fluid communication therebetween;

said first device connected to said lift member;

said second device connected to the lower level;

control means for regulating the travel length of the second part of said first device and said second device respectively, said control means functions to displace the second device with the first device when the second part of said second device moves relatively to said one part of said first device and said one part of said second device;

said one part of said first device is said first casing;

said one part of said second device is said second casing;

said second part of said first device is said first piston; and said second part of said second device is said second piston;

said control means for regulating the travel length of said first piston and said second piston simultaneously at the same rate, includes at least one housing having a first sprocket, a second sprocket, and a continuous chain;

said first sprocket and said second sprocket rotatably mounted to said first hydraulic piston cylinder device and said second hydraulic piston cylinder device and connected by said continuous chain:

said first piston and said second piston connected to said continuous chain such that said second piston moves an equal distance with respect to said first piston.

* * * * *